United States Patent [19]

Höfer et al.

[11] Patent Number: 4,722,176

[45] Date of Patent: Feb. 2, 1988

[54] SPINNING MACHINE, PARTICULARLY A RING SPINNING MACHINE

[75] Inventors: Siegfried Höfer; Wolfgang Igel, both of Ebersbach, Fed. Rep. of Germany

[73] Assignee: Zinser Textilmaschinen GmbH, Ebersbach, Fed. Rep. of Germany

[21] Appl. No.: 916,816

[22] Filed: Oct. 8, 1986

[30] Foreign Application Priority Data

Oct. 9, 1985 [DE] Fed. Rep. of Germany ..... 3536083

[51] Int. Cl.[4] ..... D01H 1/42

[52] U.S. Cl. ..... 57/352; 57/357

[58] Field of Search ..... 57/6, 97, 315, 316, 57/327, 328, 330, 352, 354, 357, 66, 67, 71, 75, 264

[56] References Cited

U.S. PATENT DOCUMENTS

| | | | |
|---|---|---|---|
| 3,070,948 | 1/1963 | Tsuzuki | 57/315 X |
| 3,153,892 | 10/1964 | Billion | 57/284 |
| 3,469,385 | 9/1969 | Tsuzuki | 57/315 X |
| 4,357,793 | 11/1982 | Gasser et al. | 57/315 X |
| 4,392,340 | 7/1983 | Horstmann et al. | 57/264 X |

*Primary Examiner*—Donald Watkins

*Attorney, Agent, or Firm*—Karl F. Ross; Herbert Dubno

[57] ABSTRACT

The spinning machine, particularly a ring spinning machine, comprises a set of drafting rolls, in which roving which runs from roving bobbins mounted over the set of drafting rolls is drawn. Between the roving bobbins and the set of drafting rolls a guide tube is mounted for guiding the roving.

11 Claims, 7 Drawing Figures

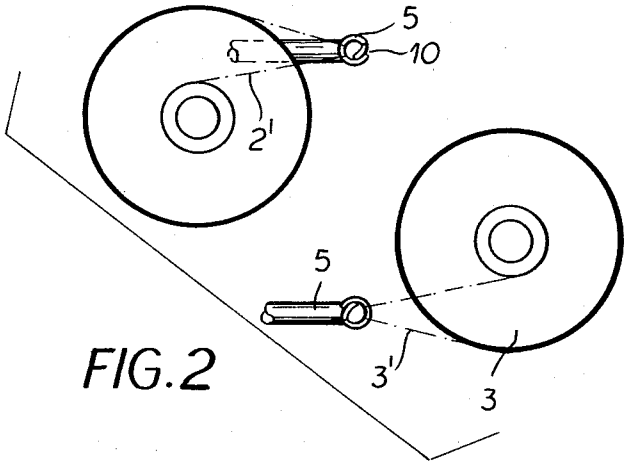
FIG.2
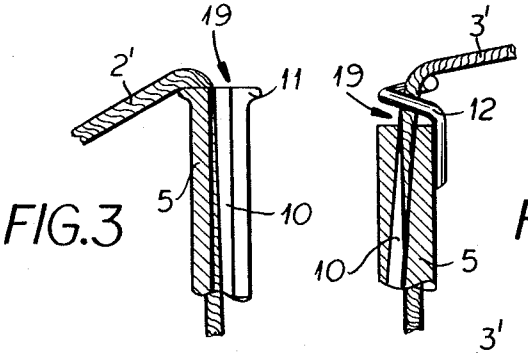
FIG.4
FIG.3
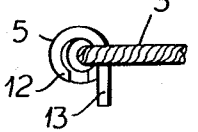
FIG.5
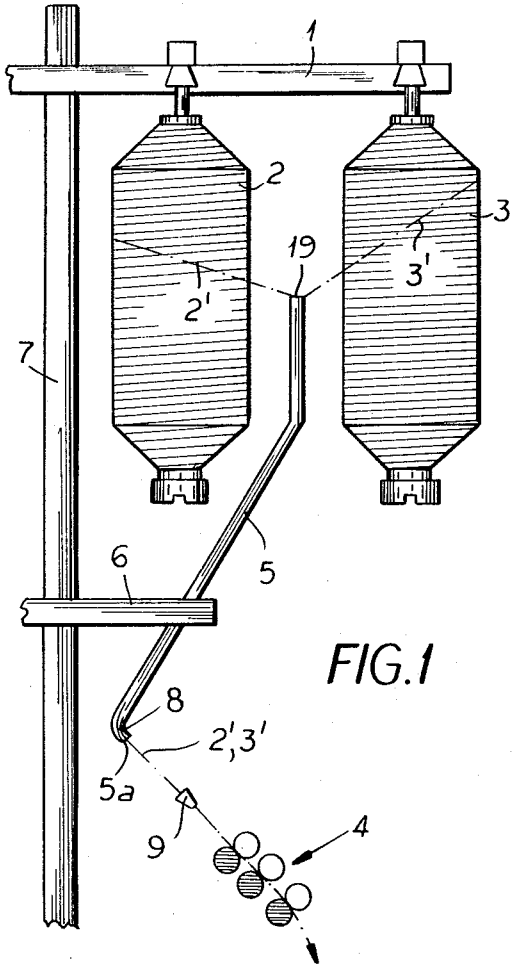
FIG.1

SPINNING MACHINE, PARTICULARLY A RING SPINNING MACHINE

FIELD OF THE INVENTION

Our present invention relates to a spinning machine and, more particularly, to a ring spinning machine with a set of drafting rolls.

BACKGROUND OF THE INVENTION

A ring spinning machine can comprise a set of drafting rolls in which roving which runs from roving bobbins mounted over the set of drafting rolls is drawn.

In a ring spinning machine the roving drawn from the roving bobbins mounted on a bobbin cross bar by the set of drafting rolls is generally guided by a running guide which is positioned near the roving bobbins and causes a tangential extraction of the roving from the roving bobbin. It is known to make a roving guide which is a rod or a U-shaped plate open on one side through whose cross section the roving is guided. From this roving guide the roving runs freely to the entrance of the set of drafting rolls.

When the roving runs off the roving bobbin, the roving end falls as soon as it passes the roving guide to the set of drafting rolls below it. There it can lead to disturbing events particularly it can wrap around the roller or can be wound into the yarn produced to form a thickened location.

OBJECT OF THE INVENTION

It is an object of our invention to provide an improved spinning machine, particularly an improved ring spinning machine with a set of drafting rolls, which obviates the above-mentioned disadvantages.

It is also an object of our invention to provide an improved spinning machine, particularly a ring spinning machine, in which flaws which result when the roving runs off the roving bobbin are avoided in an unobjectionable way.

It is an additional object of our invention to provide an improved spinning machine, particularly a ring spinning machine, in which an end of the roving falling from the roving bobbin is prevented from lodging in a part of the machine, especially a roller, and also can not become tangled with the yarn produced.

SUMMARY OF THE INVENTION

These objects and others which will become more readily apparent hereinafter are attained in accordance with our invention in a spinning machine, particularly a ring spinning machine, comprising a set of drafting rolls, in which roving which runs from the roving bobbins mounted over the set of drafting rolls is drawn.

According to our invention between the roving bobbins and the set of drafting rolls a guide tube is mounted for guiding the roving. Thus when the roving runs off the roving bobbin advantageously the dropping of the roving end causes no disadvantageous consequences regarding the set of drafting rolls or the yarn quality.

According to a feature of our invention the entrance opening of the guide tube is positioned laterally in the central region of the roving bobbin and the outlet opening of the guide tube is positioned near the entrance of the associated set of drafting rolls. Thus the roving experiences advantageously good guiding over a long region.

In order to make the insertion of the roving in the guide tube easy the guide tube can have a longitudinal slot extending over its length according to ou invention.

Also at the entrance opening of the guide tube for the roving the longitudinal slot can be positioned diametrically opposite to the roving running from the roving bobbin, thereby avoiding undesirable sliding out of the roving from the guide tube.

According to another feature of our invention a roving guide coil is provided at the entrance opening of the guide tube. Also here an undesirable sliding out of the roving from the guide tube is avoided. The guide tube can also be attached to the frame or a cross bar for the bobbins so that construction expenses can be minimized.

It is frequently necessary to be able to monitor the feed although the roving is running to the set of drafting rolls. In order to accomplish this feed properly in a further embodiment of our invention the roving can be monitored over a short unguided stretch as it is fed between the set of drafting rolls and the outlet region of the guide tube. Alternatively it is also possible to provide a break or window in the guide tube for this purpose.

According to a further feature of our invention roving breakage is detected by a photosensor for observation between the drafting rolls and the roving bobbins either at the break in the guide tube or over a short unguided stretch. The photo-sensor can include, in a single structure, a light source (e.g. a light emitting diode) and a photodetector, e.g. a photo-resistor, photo-transmitter or similar semiconductive element responsive to the failure to detect light reflected from the source by the roving.

BRIEF DESCRIPTION OF THE DRAWING

The above and other objects, features and advantages of our invention will become more readily apparent from the following description, reference being made to the accompanying highly diagrammatic drawing in which:

FIG. 1 is a schematic side elevational view of two roving bobbins with a guide tube according to our invention;

FIG. 2 is a top plan view of the apparatus of FIG. 1,

FIG. 3 is a cutaway side elevational view of the entrance of the guide tube with roving being fed into it;

FIG. 4 is a side elevational view of another embodiment of our invention showing the entrance of the guide tube with th roving guide coil;

FIG. 5 is a top plan view of the apparatus of FIG. 4; and

SPECIFIC DESCRIPTION

Figure 7:
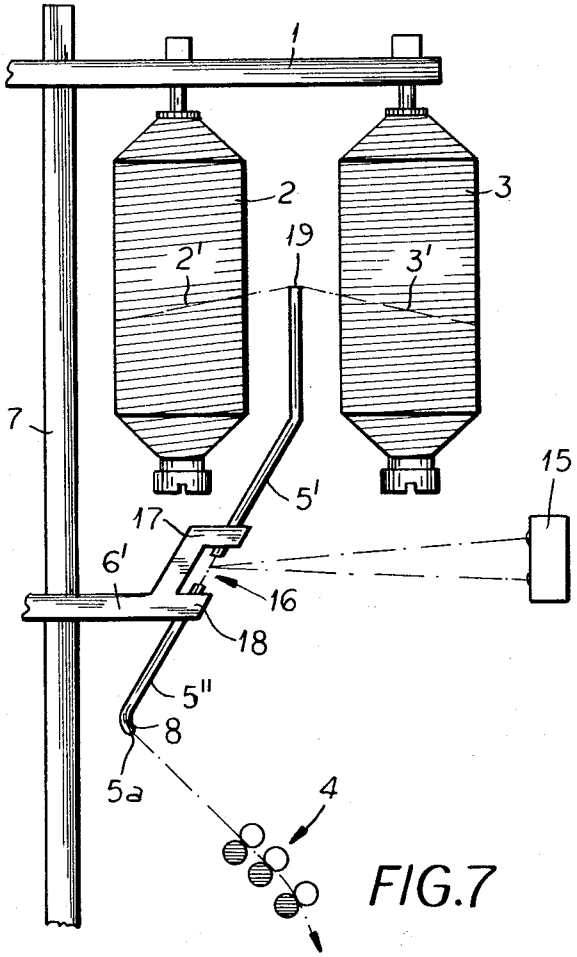
FIGS. 6 and 7 are side elevational views showing two further embodiments of the spinning machine according to our invention with the guide tube for the roving and roving bobbin cross bar.

In a spinning machine, particularly a ring spinning machine, roving bobbins 2 and 3 are mounted on a cross bar 1, for example in a suspended configuration. Under these roving bobbins 2 and 3 a set of drafting rolls 4 is provided. Roving 2' and 3' is pulled from the roving bobbins 2 and 3 and fed to the appropriate set of drafting rolls 4 through an entrance or entrance point 9.

Between each bobbin 2 or 3 and the associated set of drafting rolls 4 a respective guide tube 5 for guiding the roving 2' and 3' is positioned. By this guide tube 5 the roving 2' or 3' is guided from the vicinity of the bobbin cross bar 1 until at least to a point in the vicinity of the set of drafting rolls 4, from which the free fall of the roving as it is pulled from the roving bobbins 2 and 3 can occur without disadvantageous consequences.

In the structure according to FIG. 1 the guide tube 5 is mounted by a holder 6 on the frame 7 for the bobbin cross bar 1, whereby as is apparent from FIG. 1 the entrance opening 19 of the guide tube 5 is positioned laterally in the central region adjacent the roving bobbins 2 and 3 and the outlet opening 5*a* of the guide tube 5 adjacent the entrance to the associated set of drafting rolls 4. In the lower region in the embodiment according to FIG. 1 the guide tube 5 is provided with a bend 8 in order to guarantee a smooth continuous running of the roving 2' and 3'.

From FIG. 2 it is apparent that each individual roving 2' and 3' is associated with one such guide tube 5.

Each guide tube 5 (FIG.3) is provided with a longitudinal slot 10 to make the insertion of roving easier. This longitudinal slot 10, as is apparent from FIG. 3, is on the side of the entrance opening 19 of the guide tube 5 diametrically opposed to the side to which the roving 2' runs from the roving bobbin 2. Hence an undesired sliding of the guided roving 2' out of the tube 5 is avoided. Further in the embodiment according to FIG. 3 the entrance opening 19 is provided with a circumferential protruding lip 11 in order to avoid damage to the roving 2' at the entrance opening.

From FIGS. 4 and 5 the guide tube 5 can be seen to have a roving guide coil 12 near the entrance opening 19 for the appropriate roving 3'. This roving guide coil 12 has a linear guide piece 13 at its end according to FIG. 5 to make the insertion of the roving 3' into the guide tube 5 easier. Again a longitudinal slot 10 is provided which extends diagonally over the entire tube length.

Figure 6:
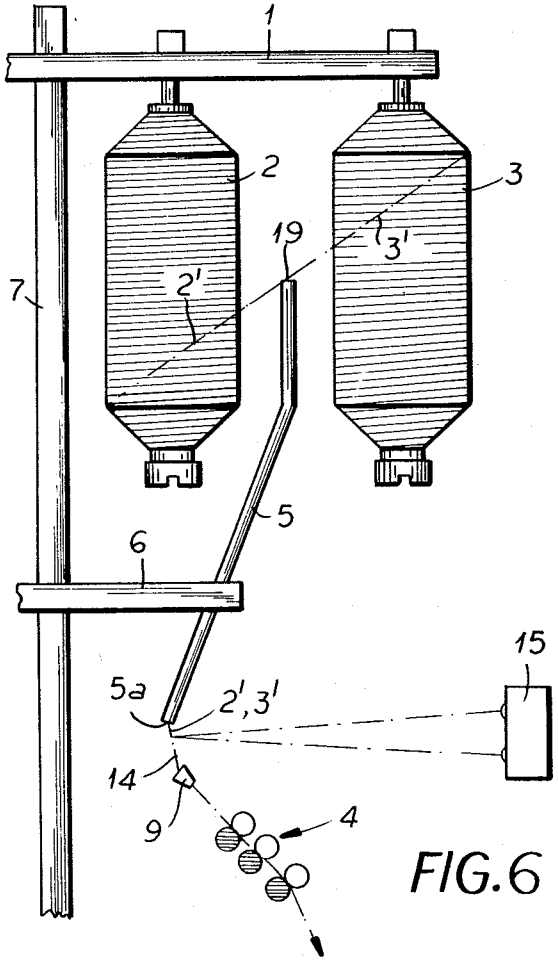

In the embodiment of FIG. 6 the length of the guide tube 5' is so dimensioned that between the entrance to the set of drafting rolls 4, that is, the entrance point 9, and the outlet opening 5*a* of the guide tube 5 the roving 2' and 3' is fed over a short unguided stretch 14 for observation or monitoring of roving breakage. Thus it is possible for an operator to see whether the roving 2' and 3' is running correctly to the set of drafting rolls 4.

It is also possible to monitor the roving with a photosensor 15 in this same region 14. This photosensor 15 can be mounted in an automatic device for automatic lifting or the upper rolls of the drafting from 4 in the case of a roving break.

In the embodiment according to FIG. 7 to allow for monitoring the guide tube 5 is divided into two sections, a guide tube section 5' and a guide tube section 5''. Between them there is a break 16. Thus the holder 6 has two arms 17 and 18 and the arm 17 holds the guide tube section 5' and the arm 18 holds the guide tube section 5''. Near the break 16 a photosensor 15 can be mounted. It is also possible to provide instead of a break 16 a window in the guide tube 5, although this has not be illustrated.

By the suitable mounting of the guide tube 5 for each individual piece of roving 2' and 3' a very good guiding of the roving advantageously occurs whereby the undesirable free fall of the roving with the resulting disturbing problems is avoided unobjectionally in a simple way.

We claim:

1. In a spinning machine, particularly a ring spinning machine, with a set of drafting rolls mounted within the spinning machine, in which roving is drawn which runs from a plurality of roving bobbins mounted over said set of drafting rolls, the improvement wherein between said roving bobbins and said set of drafting rolls a guide tube is mounted for guiding said roving, and an opening of the guide tube is positioned laterally in a central region of the roving bobbin and an outlet opening of the guide tube is positioned near an entrance of the set of drafting rolls, said guide tube serving to prevent loose ends of said roving from lodging in a part of the machine and also preventing tangling with any yarn produced therefrom.

2. The improvement defined in claim 1 wherein an entrance opening of said guide tube is positioned laterally in the central region of said roving bobbins and the outlet opening of said guide tube is positioned near the entrance of said set of drafting rolls.

3. The improvement defined in claim 1 wherein said guide tube has a longitudinal slot penetrating said guide tube.

4. The improvement defined in claim 3 wherein at said entrance opening for said roving in said guide tube said longitudinal slot is positioned diametrically opposed to said roving running to said guide tube from said roving bobbins.

5. The improvement defined in claim 1 wherein at said entrance opening for said roving in said guide tube a roving guide coil is positioned.

6. The improvement defined in claim 1 wherein said guide tube is mounted on a frame for a cross bar for said roving bobbins.

7. The improvement defined in claim 11 wherein between the entrance of said set of drafting rolls and the outlet opening of said guide tube said roving is fed over a short unguided stretch for monitoring of the roving.

8. The improvement defined in claim 11 wherein said guide tube has an opening therein for monitoring of the roving.

9. The improvement defined in claim 8 wherein a photosensor is positioned for observation of said roving guided in said guide tube between said set of drafting rolls and said roving.

10. A spinning machine, particularly a ring spinning machine, comprising a set of drafting rolls;

a plurality of roving bobbins mounted over said set of drafting rolls from which roving is drawn;

a guide tube mounted on a frame for a cross bar for said roving bobbins, said guide tube guiding said roving between said roving bobbins and said set of drafting rolls having an entrance opening positioned laterally in the central region of said roving bobbins and an outlet opening positioned near the entrance of said set of drafting rolls;

a longitudinal slot formed in said guide tube for said roving;

a roving guide coil positioned at said entrance opening for said roving in said guide tube; and a photosensor positioned for observation of said roving guided in said guide tube between said set of drafting rolls and said roving bobbins.

11. In a spinning machine, particularly a ring spinning machine, with a set of drafting rolls, in which roving is drawn which runs from a plurality of roving bobbins mounted over said set of drafting rolls, the improvement wherein between said roving bobbins and said set of drafting rolls a guide tube is mounted for guiding said roving, and wherein said guide tube has a longitudinal slot penetrating said guide tube.

* * * * *